United States Patent [19]

Blutstein

[11] Patent Number: 4,941,211

[45] Date of Patent: Jul. 17, 1990

[54] COLD WEATHER HOOD

[75] Inventor: Morton Blutstein, Milwaukee, Wis.

[73] Assignee: Reliable Knitting Works, Milwaukee, Wis.

[21] Appl. No.: 337,959

[22] Filed: Apr. 14, 1989

[51] Int. Cl.[5] ..... A42B 1/04; A42B 3/18

[52] U.S. Cl. ..... 2/202; 2/206

[58] Field of Search ..... 2/9, 91, 173, 202, 203, 2/206

[56] References Cited

U.S. PATENT DOCUMENTS

| | | | |
|---|---|---|---|
| 1,235,927 | 8/1917 | Sanborn | 2/173 |
| 3,271,781 | 9/1966 | Sontag et al. | 2/173 |
| 3,531,952 | 10/1970 | Chesebro, Jr. | 2/202 |
| 3,717,882 | 2/1973 | Schuessler | 2/202 |
| 3,740,767 | 6/1973 | Schuessler | 2/202 |
| 4,300,240 | 11/1981 | Edwards | 2/206 |
| 4,825,474 | 5/1989 | Edwards | 2/206 |

*Primary Examiner*—Werner H. Schroeder
*Assistant Examiner*—Gloria Hale
*Attorney, Agent, or Firm*—Michael, Best & Friedrich

[57] ABSTRACT

A cold weather hood which may be worn by an individual to protect them from the effects of a cold weather environment, the cold weather hood including a hood member dimensioned to enclose the head of the individual and which has an opening of predetermined dimensions to receive the face of the individual, and a face mask manufactured of double-sided, brushed Dacron® polyester fiber is secured in the opening of the hood thereby enclosing the entire head of the individual.

5 Claims, 1 Drawing Sheet

COLD WEATHER HOOD

FIELD OF THE INVENTION

The present invention relates to cold weather clothing, and more particularly to a cold weather hood which includes a face mask portion composed of a double-sided, brushed, Dacron® Polyester fabric, the material of the face mask permitting an individual to wear the cold weather hood for extended periods of time in complete comfort, and which further insulates and protects the users face from the effects of cold temperatures as well as moisture.

BACKGROUND

A cap or hood having a cold weather face mask is disclosed in U.S. Letters Pat. No. 4,300,240 to Edwards. The prior art also includes other cold weather caps or hoods having face masks manufactured from materials such as cotton, and various synthetic fibers. While these materials will generally keep an individual warm, they may not be as effective an insulator when exposed to environmental conditions which include either high winds, or moisture, and extremely cold temperatures. Under these circumstances, water vapor in the breath of the user may condense or freeze on the face mask.

Still another significant problem with the prior art cold weather garments results from characteristics inherent in their individual designs. As earlier discussed, the knitted materials incorporated into the prior art cold weather garments have frequently had insulative characteristics which decrease when they are individually exposed to moisture. Further these same materials often have surface texture characteristics which may irritate the skin of the user if the garment is worn in contact with the surface of the skin for extended periods of time. Moreover, prior art materials have often had surface texture characteristics such that when they are individually brushed against other objects, they may tend to produce audible noise. This is an undesirable characteristic in those circumstances where the user may be wearing the hood while hunting.

SUMMARY OF THE INVENTION

Therefore it is an object of the present invention to provide an improved cold weather hood having a face mask.

Another object of the present invention is to provide a cold weather hood which is comfortable to wear for prolonged periods of time, and which further has improved insulative characteristics.

Another object of the present invention is to provide a cold weather hood which includes a hood member that is conformably dimensioned to enclose the head of an individual and which further has an opening for the face of the wearer, and a face mask manufactured from a double sided, brushed polyester fiber is secured in the opening of the hood thereby covering the face of the wearer.

Another object of the present invention is to provide a cold weather hood which is characterized by simplicity of design ease of utilization, and which can be economically manufactured.

Another object is to provide such a cold weather hood which is operable to obtain the individual benefits to be derived from related prior art cold weather garments while avoiding the detriments individually associated therewith.

Further objects and advantages are to provide improved elements and arrangements thereof in a cold weather hood for the purposes described, which is dependable, durable, and fully effective in accomplishing its intended purposes.

These and other objects and advantages are achieved in the cold weather hood of the present invention wherein a face mask comprised of a double sided, brushed, Dacron® polyester fiber is incorporated into a cold weather hood which encloses the head of an individual, the face mask including a unitary first piece which has openings for the individuals eyes, nose and mouth, and a second nose piece is secured on the first piece and is adapted to cover the bridge of the users nose, the face mask of the cold weather hood imparting improved performance characteristics to a cold weather hood which has such a construction.

DESCRIPTION OF THE PREFERRED EMBODIMENT

Figures 1, 2, 3, 4, 5, 6:
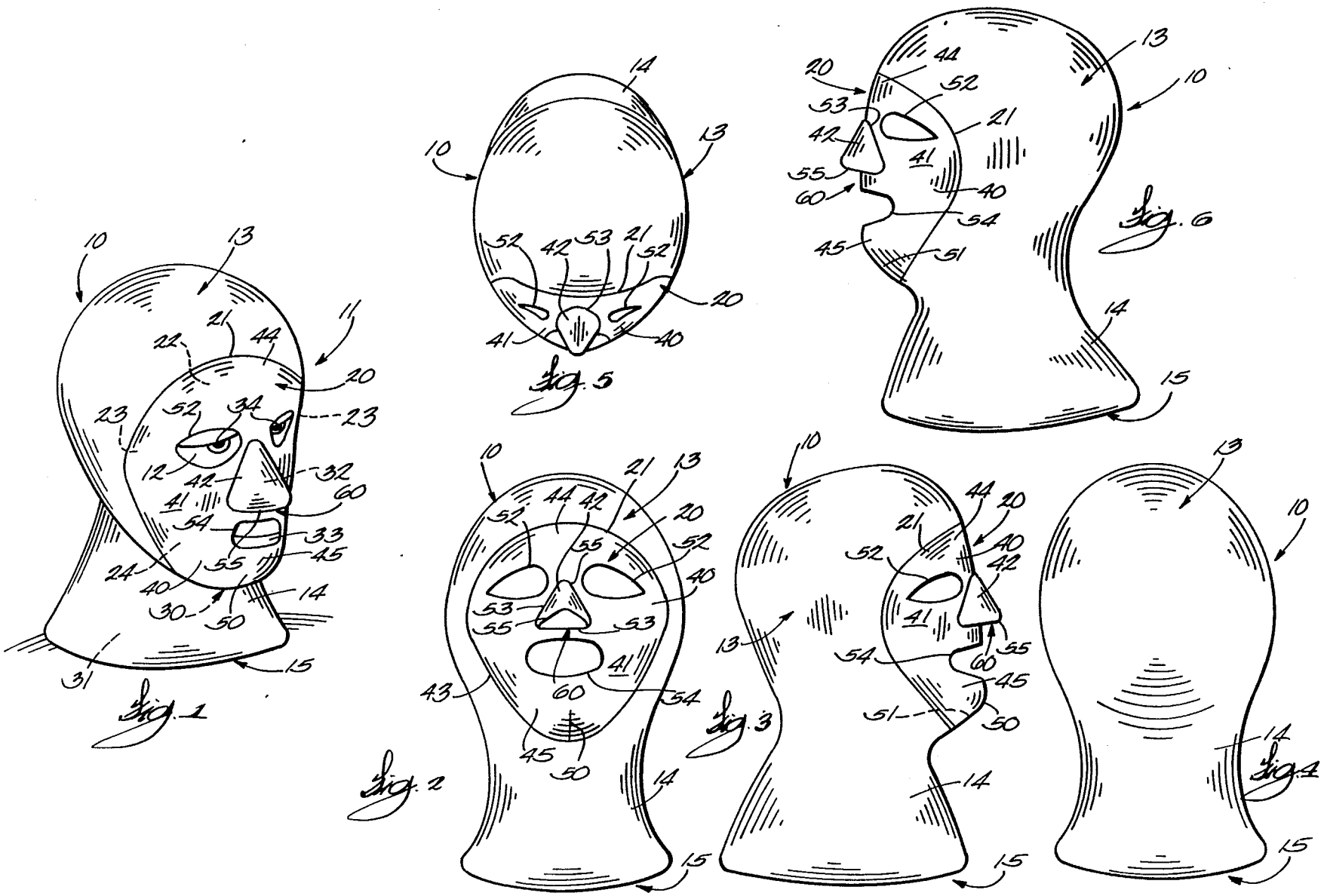
FIG. 1 is perspective view of the cold weather hood of the present invention worn on the head of a sportsman.
FIG. 2 is a front elevation of the cold weather hood of the present invention.
FIG. 3 is right side elevation of the cold weather hood of the present invention.
FIG. 4 is a rear elevation of the cold weather hood of the present invention.
FIG. 5 is a plan view of the cold weather hood of the present invention.
FIG. 6 is a left side elevation view of the cold weather hood of the present invention.

Referring more particularly to the drawings, the cold weather hood of the present invention is generally indicated by the numeral 10 in FIG. 1. For illustrative convenience, the cold weather hood is shown as it would appear when it was worn on the head of a sportsman or hunter 11. As best illustrated by reference to FIG. 1, the cold weather hood 10 is adapted substantially to enclose the face 12 of the hunter thereby protecting it from the effects of the cold weather environment.

The cold weather hood 10 has a hood member, which is generally indicated by the numeral 13, and which further includes an elongated neck portion 14 that defines a passageway 15. The passageway is dimensioned so as to permit movement of the hunter's head through the passageway and into the hood member 13. Further, the hood member 13 has an opening 20 formed therein, the opening defined by a periphery 21. As best illustrated by reference to FIG. 1, and when the head of the hunter is in the hood member, the periphery 21, that defines the opening 20, extends along the forehead 22, across both temples 23, over the cheeks 24, and extends to a position, just underneath the chin 30. As is best illustrated by reference to FIG. 1, the neck 31 of the hunter is enclosed in the neck portion 14. Further, the nose, mouth and eyes 32, 33 and 34 are positioned in the opening 20.

A face mask member 40 is secured in the opening 20 by conventional stitching or another suitable fastening technique. The face mask member 40 includes a unitary first piece 41, and a second or nose piece 42 is sewn or otherwise affixed to the first piece. The nose piece 42 is operable to shield or otherwise insulate the hunter's nose 32 thereby protecting it from the effects of the cold weather environment. As best seen by reference to FIGS. 2 and 5, the second or nose piece is roughly triangular in shape. Further, the first piece 41 has a top portion 44, and a bottom portion which is generally indicated by the numeral 45.

As best illustrated by reference to FIG. 2 and 3, a seam 50 is formed in the bottom portion 45 of the first piece 41, the seam forming an inwardly disposed substantially concavely shaped surface 51 which covers the chin 30 of the hunter. Further, the first piece has a pair of eye openings 52, as well as nose and mouth openings 53 and 54 respectively. As best seen by reference to FIG. 2, the nose piece 42 has a peripheral edge 55 which defines a breathing aperture 60. The hood member 13 may be manufactured out of assorted knitted materials which may include both natural and various synthetic fibers. However, the inventors have discovered it useful to utilize a double-sided, brushed, Dacron® polyester fleece fabric for the face mask member 40. Dacron® is a registered trademark of the DuPont Company.

The inventors have discovered that the double-sided, brushed Dacron® polyester fabric operates as both a fabric, and as an insulative material. More particularly, it has been discovered that the double-sided, brushed Dacron® polyester fabric has a characteristic tendency to retain very little moisture. Further, it displays the desirable characteristics of drying quickly and insulating effectively even when it is wet. Further, double-sided, brushed Dacron® polyester fabric is free hanging, that is, it does not have to be quilted or otherwise combined with other materials. Another desirable characteristic of the double-sided, brushed Dacron® polyester fabric is that it possesses an extremely soft finish which permits it to be worn in contact with the surface of the skin for long periods of time without producing an irritating effect. For example, many individuals find it uncomfortable to wear wool directly in contact with the surface of their skin for extended periods of time. This soft finish has an additional benefit in that it does not tend to produce audible noise when it is brushed against other objects. Moreover, and as compared to wool or fleece, the present material utilized in the face mask portion appears to offer approximately the same insulation effect with approximately half the weight of wool, and is not as bulky as down insulation and other synthetic fiberfills. The unique insulation characteristics of the double-sided, brushed Dacron® polyester fabric appears to lie in its construction inasmuch as it appears to create an air space thereby trapping body heat in much the same way as down and synthetic fiberfills. However, and as earlier discussed, a substantial advantage of using the above identified material is that it requires no other fabric to support it. Further, it has been discovered that the material utilized in the face mask portion is operable to absorb moisture created by overheating while simultaneously insulating thereby protecting the hunters or sportsmans face from the effects of cold temperatures.

Therefore, it will be seen that the cold weather hood of the instant invention is operable to protect a user's head from the effects of a cold weather environment, and further includes a face mask portion having a surface texture and insulative characteristics which permits it to be worn in contact with the surface of the skin for extended periods of time in complete comfort.

I claim:

1. A cold weather hood which is worn on an individuals head comprising:

a hood member adapted to cover the wearer's head, the hood member having an opening for the face of the wearer; and a face mask manufactured from double-sided, brushed polyester fiber, the face mask being secured in the opening of the hood member and for covering the face of the wearer.

2. The cold weather hood of claim 1 wherein the opening in the hood exposes that portion of the individual's face along a line which extends from just above the eyebrows, over the temples, and cheeks, and to a location under the chin.

3. The cold weather hood of claim 2 wherein the face mask includes a unitary first piece which has openings for the individual's eyes, nose, and mouth, and a second piece is secured to the first piece and is adapted to cover the individual's nose.

4. The cold weather hood of claim 3 wherein the face mask has a peripheral edge, and a top and bottom portion, and the bottom portion has a seam which defines an inwardly disposed concavely curved portion which is conformably dimensioned to receive the chin of the individual.

5. The cold weather hood of claim 4 wherein the nose piece conformably is dimensioned to cover the entire length of the nose, and which defines a breathing aperture which exposes the nostrils of the individual.

* * * * *